US010602260B2

(12) United States Patent
Kim

(10) Patent No.: US 10,602,260 B2
(45) Date of Patent: Mar. 24, 2020

(54) NOISE BLOCKING BLUETOOTH EARSET WITH INTEGRATED IN-EAR MICROPHONE

(71) Applicant: Orfeo SoundWorks Corporation, Anyang (KR)

(72) Inventor: Eundong Kim, Uiwang (KR)

(73) Assignee: Orfeo SoundWorks Corporation, Anyang (KR)

( * ) Notice: Subject to any disclaimer, the term of this patent is extended or adjusted under 35 U.S.C. 154(b) by 0 days.

(21) Appl. No.: 16/446,591

(22) Filed: Jun. 19, 2019

(65) Prior Publication Data

US 2019/0306610 A1 Oct. 3, 2019

Related U.S. Application Data

(63) Continuation-in-part of application No. 16/092,460, filed as application No. PCT/KR2016/013993 on Nov. 30, 2016.

(30) Foreign Application Priority Data

Apr. 19, 2016 (KR) ..... 10-2016-0047717
May 9, 2016 (KR) ..... 10-2016-0056134

(51) Int. Cl.

| | |
|---|---|
| ***H04R 1/08*** | (2006.01) |
| ***H04R 1/10*** | (2006.01) |
| *H04R 9/06* | (2006.01) |
| *H04R 9/02* | (2006.01) |

(52) U.S. Cl.

CPC ..... *H04R 1/1083* (2013.01); *H04R 1/1016* (2013.01); *H04R 1/1075* (2013.01); *H04R 9/025* (2013.01); *H04R 9/06* (2013.01); *H04R 2400/11* (2013.01)

(58) Field of Classification Search

CPC ..... H04R 1/1083; H04R 1/10; H04R 1/1075; H04R 9/02; H04R 9/06; H04R 11/02; H04R 31/00; H04R 9/025

See application file for complete search history.

(56) References Cited

U.S. PATENT DOCUMENTS

| | | | |
|---|---|---|---|
| 2007/0154050 | A1 | 7/2007 | Kim |
| 2009/0161885 | A1 | 6/2009 | Donaldson et al. |
| 2018/0221209 | A1 | 8/2018 | Ogut et al. |

FOREIGN PATENT DOCUMENTS

| | | | |
|---|---|---|---|
| JP | 2011-188177 | A | 9/2011 |
| KR | 10-2014-0068629 | A | 6/2014 |
| KR | 10-1423570 | B1 | 7/2014 |
| KR | 10-1551565 | B1 | 9/2015 |

*Primary Examiner* — Regina N Holder

(74) *Attorney, Agent, or Firm* — Patent Office of Dr. Chung Park

(57) ABSTRACT

Disclosed are a noise blocking earset and a method for manufacturing same. A noise blocking earset has a driver unit, having a back hole formed thereon, and a case having the driver unit embedded therein and micro holes, which communicate with the back hole, formed thereon. Or, the noise blocking earset comprises a driver unit, having a back hole formed thereon, and a case, having the driver unit embedded therein, and has a blocking member, having micro holes formed thereon, inserted into a hole. Or, the noise blocking earset has a driver unit, having a back hole formed thereon, a case, having the driver unit embedded therein, and a blocking member coupled to the case or the back hole of the driver unit and having micro holes formed thereon.

5 Claims, 8 Drawing Sheets

NOISE BLOCKING BLUETOOTH EARSET WITH INTEGRATED IN-EAR MICROPHONE

CROSS REFERENCE TO RELATED APPLICATION OF THE INVENTION

This application is a continuation-in-part application of U.S. patent application Ser. No. 16/092,460, filed on Oct. 10, 2018, which is a national Stage Patent Application of PCT International Patent Application No. PCT/KR2016/013993, filed on Nov. 30, 2016 under 35 U.S.C. § 371, which claims priority of Korean Patent Application Nos. 10-2016-0047717 and 10-2016-0056134, filed on Apr. 19, 2016 and May 9, 2016, respectively, which are all hereby incorporated by reference in their entirety.

TECHNICAL FIELD

The present invention relates to a noise blocking technique, and more specifically, to a noise blocking earset and a manufacturing method thereof, which can keep the atmospheric pressure inside and outside of the earset equal and effectively block external noises.

BACKGROUND ART

There are various kinds of earsets, and an in-ear earphone which receives sound while being inserted an ear canal of an ear flap is generally referred to as an earset.

Meanwhile, as the earset is inserted in the ear canal, an atmospheric pressure difference occurs between the inside (human body pressure) and the outside (atmospheric pressure) of the earset. That is, as an eartip formed in the earset is tightly attached to the inner wall of the ear canal, the atmospheric pressure difference occurs between the inside and the outside of the earset.

However, the atmospheric pressure difference influences a diaphragm, and a phenomenon of shifting the diaphragm toward the outside of the earset occurs.

To prevent the shift of the diaphragm, a back hole exists on the rear side of a dynamic driver unit and a balanced armature driver unit. The back hole performs a function of keeping the pressure inside and outside of the earset equal. Therefore, vibration occurs when the diaphragm is at a right position. In addition, when the back holes are covered by dampers or the like of different mesh densities, a pressure difference occurs when the diaphragm operates, and this may be used for tuning.

However, the back hole has a problem of working as a path for inputting external noises. That is, as shown in FIG. 1, a hole H exists in a case 2 which accommodates a driver unit 1, and the hole H formed in the case 2 and the back hole BH formed in the driver unit 1 work as a path through which external noises flow in. Therefore, the external noises should be perfectly blocked to be used in a place where perfect blocking of the external noises is needed, for example, an airport or the like. However, it is difficult to perfectly block the external noises due to the existence of the hole H formed in the case 2 and the back hole BH formed in the driver unit 1.

Meanwhile, an earset which integrates a speaker and a microphone performs a function of transferring sound to the ear canal and a function of collecting user's voice in one body. In the earset having such a structure, it is general that the speaker is installed toward the ear canal to transfer sound, and the microphone is installed toward the outside of the ear flap to collect user's voice. Therefore, a sound collection hole is formed in the case exposed to the outside of the ear flap so that the microphone may collect sound, and there is a problem in that external noises flow in through the sound collection hole, and the external noises are transferred to the back hole formed on the rear side of the driver unit. Meanwhile, even in the case of the in-ear microphone in which the microphone faces the ear canal, there is a problem in that the sound quality is lowered due to the external noises regardless of the installation position of the in-ear microphone. However, if the back hole formed on the rear side of the driver unit is blocked, a phenomenon of shifting the diaphragm occurs as described above, and it cannot be used in an airplane or a high mountain area.

Therefore, a method of blocking the external noises flowing in through the back hole formed on the rear side of the dynamic driver unit and the balanced armature driver unit, and allowing inflow of air is needed.

DISCLOSURE OF INVENTION

Technical Problem

An object of the present invention is to provide a noise blocking earset and a manufacturing method thereof, which can keep the atmospheric pressure inside and outside of the earset equal and effectively block external noises by forming at least one micro hole, which communicates with a back hole, in the earset case (rear side unit) exposed to the outside of an ear flap.

Technical Solution

To accomplish the above object, according to one aspect of the present invention, there is provided a noise blocking earset comprising: a driver unit having a back hole formed thereon; and a case having the driver unit installed therein and having a micro hole formed thereon to communicate with the back hole. At this point, at least one micro hole may be formed on a rear side of the case.

In addition, a noise blocking earset of the present invention includes: a driver unit having a back hole formed thereon; and a case having the driver unit installed therein, and a blocking member having a micro hole formed thereon may be inserted in the back hole.

In addition, a noise blocking earset of the present invention includes: a driver unit having a back hole formed thereon; a case having the driver unit installed therein; and a blocking member having a micro hole formed thereon and combined with the back hole of the driver unit or the case.

At this point, it is preferable that a ratio of a diameter D of the micro hole to a thickness T of the case is set within a range of 1:100 to 1,000. Here, diameters of an inlet and an outlet through which external noises flow in and out may be the same or set within a range of 1:10 to 100 or 100 to 10:1.

In addition, the blocking member includes a plurality of blocking plates, and micro holes formed on the blocking plates may have diameters different from each other.

On the other hand, a method of manufacturing a noise blocking earset of the present invention includes the steps of: manufacturing a case having a blocked rear side; determining a diameter D of a micro hole corresponding to a thickness T of the case; forming at least one micro hole on the case; and completing the earset by assembling components including a driver unit having a back hole formed thereon.

In addition, a method of manufacturing a noise blocking earset of the present invention includes the steps of: manufacturing a blocking member; determining a diameter D of a micro hole corresponding to a thickness T of the blocking member; forming at least one micro hole on the blocking member; and completing the earset by assembling components.

At this point, it is preferable that the diameter D of the micro hole is determined within a range of 1:100 to 1,000 with respect to the thicknesses T of the case and the blocking member.

Advantageous Effects

According to the present invention, high and intermediate frequency bands are removed through the micro holes formed on the rear side of an earset, and actually only the sound of a low frequency band of 100 HZ or lower passes through, and since low frequency sound is filtered and does not pass through in the signal processing procedure by the Bluetooth specification, the air passes through, and the external noises can be blocked as a result.

BEST MODE FOR CARRYING OUT THE INVENTION

Figure 1:
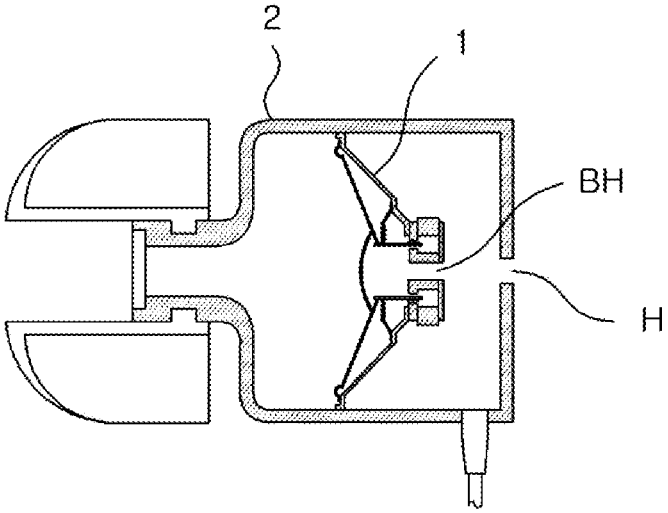
FIG. 1 is a cross sectional view showing an existing earset.

The present invention will be hereafter described in detail with reference to the preferred embodiments of the present invention and the accompanying drawings, and it will be described assuming that elements having like functions will be denoted by like reference numerals.

When it is referred that an element "includes" another element in the detailed description or claims of the present invention, it should be understood that this is not interpreted as being configured of only the corresponding element, but may further include other elements, as far as an opposed description is not specially specified.

Hereinafter, an example of implementing a noise blocking earset of the present invention and a manufacturing method thereof will be described through a specific embodiment.

Figure 2:
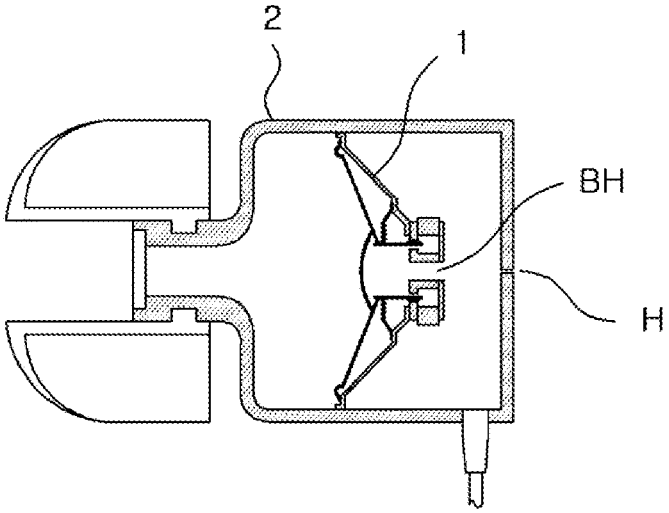
FIG. 2 is a cross sectional view showing a noise blocking earset according to an embodiment of the present invention.

FIG. 2 is a cross sectional view showing a noise blocking earset according to an embodiment of the present invention.

Referring to FIG. 2, a noise blocking earset of the present invention includes a driver unit 1 having a back hole BH formed thereon, and a case 2 having the driver unit 1 installed therein and having a micro hole H formed thereon to communicate with the back hole BH.

Although an earset applied with a dynamic driver unit is proposed in this embodiment, the same technique may be applied to an earset applied with a balanced armature driver unit.

The noise blocking earset of the present invention configured like this keeps the atmospheric pressure inside and outside of the earset equal and blocks flowing-in external noises using the micro hole H communicating with the back hole BH.

Figure 3:
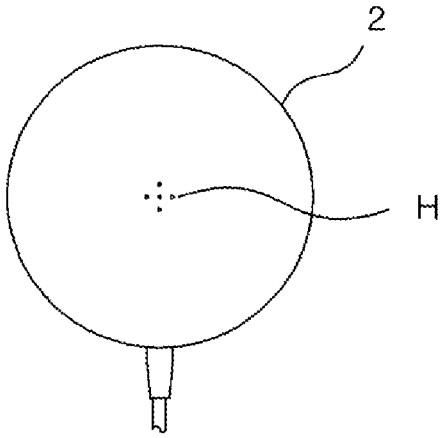
FIG. 3 is a rear view showing a noise blocking earset according to an embodiment of the present invention.

FIG. 3 is a rear view showing a noise blocking earset according to an embodiment of the present invention.

Referring to FIG. 3, the micro hole H is formed on the rear side of the case 2, and at least one micro hole H may be formed.

Meanwhile, tuning is also possible in correspondence to the positions of and the number of micro holes H.

Figure 4:
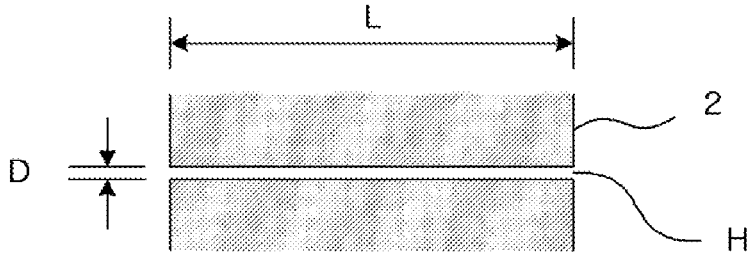
FIGS. 4 to 6 are views showing the structure of a micro hole applied to the present invention.
Figure 5:
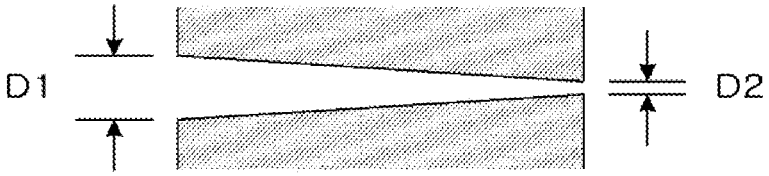
Figure 6:
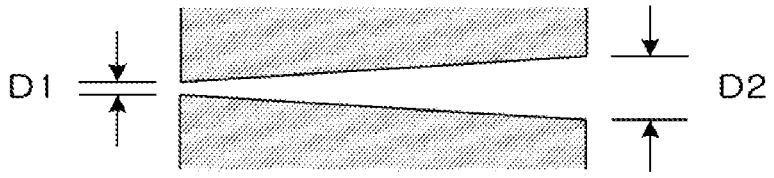

FIGS. 4 to 6 are views showing the structure of a micro hole applied to the present invention.

Referring to FIGS. 4 to 6, it is preferable to determine the diameter D of the micro hole H considering the thickness T of the case 2.

That is, it is preferable that the ratio of the diameter of the micro hole H to the thickness of the case 2 is set within a range of 1:100 to 1,000.

For example, when the thickness T of the case 2 is 1 mm (1,000 μm), the diameter of the micro hole H may be set within a range of 1 to 10 μm.

Meanwhile, thickness T of the case 2 may be determined considering the diameter D of a processable micro hole H, and particularly, it will be preferable that only the thickness of the rear side unit is adjusted.

In addition, the shape of the micro hole H may be diversely formed considering its usage, a used area (high or low altitude area) or the like of the earset.

The diameters of the inlet and the outlet may be formed to be the same as shown in FIG. 4, or the diameters of the inlet and the outlet may be formed to be different from each other as shown in FIGS. 5 and 6. When the diameters of the inlet and the outlet are formed to be different from each other, the ratio between the diameters of the inlet and the outlet is preferably about 1:10 to 100 or 100 to 10:1. At this point, it is preferable that the ratio of the diameter D2 or D1 of the micro hole H to the thickness T of the case 2 is set within a range of 1:100 to 1,000 on the basis of the diameter of the smaller (D2 of FIG. 5 or D1 of FIG. 6).

As described above, the micro hole H formed in the earset case 2 filters flowing-in external noises. That is, high and intermediate frequency bands are absorbed while passing through the micro hole H, and only sound of a low frequency band lower than 100 Hz passes through. In addition, since a state of communicating air with the back hole BH is maintained, the atmospheric pressure inside and outside of the earset is maintained equal. As a result, although the air passes through the micro hole H, most of the external noises are blocked.

Figure 7:
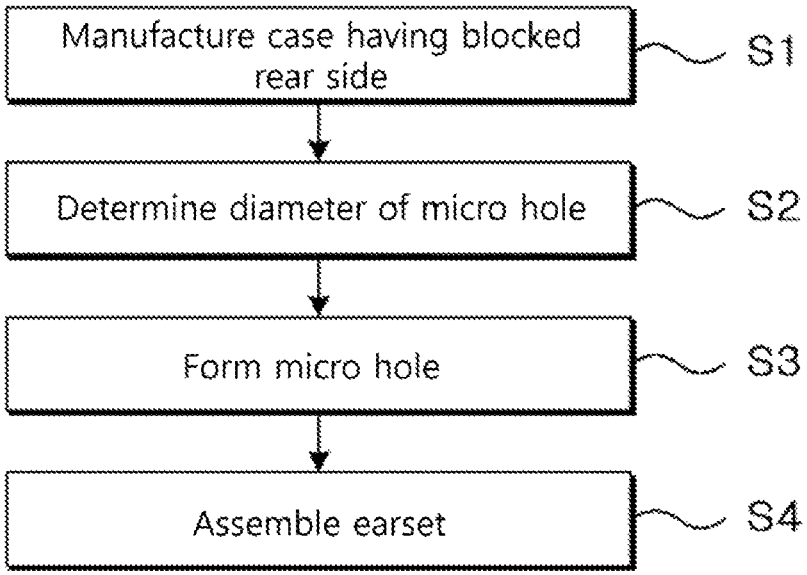
FIG. 7 is a flowchart illustrating a method of manufacturing a noise blocking earset according to an embodiment of the present invention.

FIG. 7 is a flowchart illustrating a method of manufacturing a noise blocking earset according to an embodiment of the present invention.

Referring to FIG. 7, the case 2 is manufactured using a plastic material of the earset case 2 (step S1). At this point, the rear side of the case 2 maintains a blocked state. It is preferable to apply a casting process using a mold in manufacturing the case 2.

Subsequently, a diameter D of the micro hole H is determined within a range of 1:100 to 1,000 with respect to the thickness T of the case 2 (step S2), and at least one micro hole H is formed on the rear side of the case 2 (step S3). At this point, the micro hole H may be perforated using a laser or the like, and when the size of the micro hole H is 10 μm or less, a semiconductor etching process may be applied.

Then, an earset is completed by assembling the components including the driver unit 1 having a back hole BH formed thereon.

Although a case of forming a micro hole H on the case 2 itself is described in the above embodiment, a blocking member configured of only a part having a micro hole H formed thereon may be separately manufactured and combined with the earset case 2. In addition, the blocking member may be installed in the back hole BH of the driver unit 1. In this case, an ordinary hole (1 mm or larger) formed through an existing process may be formed in the case 2.

Figure 8:
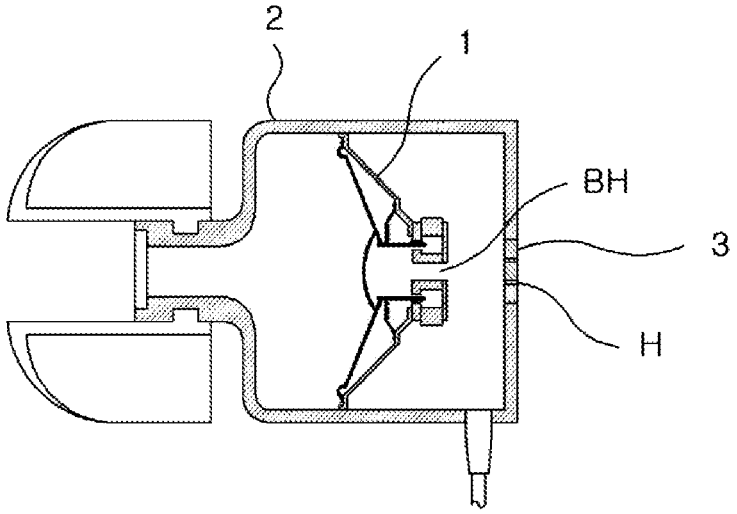
FIG. 8 is a cross-sectional view showing a blocking plate combined with a case as another embodiment of the present invention.

FIG. 8 is a cross-sectional view showing a blocking plate combined with a case as another embodiment of the present invention.

Referring to FIG. 8, a blocking plate 3 having micro holes H formed thereon may be separately manufactured and combined with the case 2.

Although an example of combining the blocking plate 3 on the rear side is described in this embodiment, the blocking plate 3 may be combined at any position.

Figure 9:
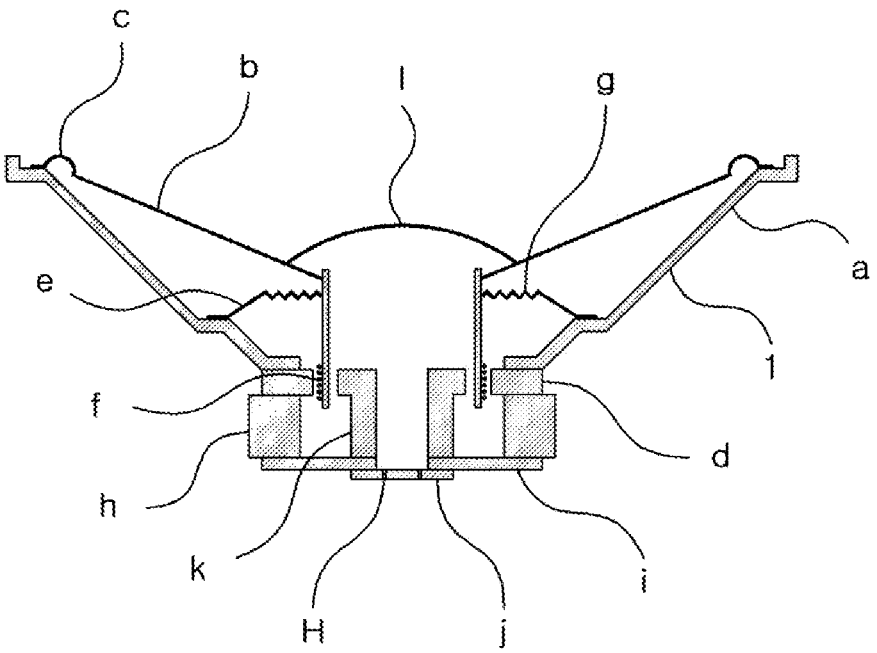
FIGS. 9 and 10 are cross-sectional views showing a blocking plate combined with a back hole of a driver unit as still another embodiment of the present invention.
Figure 10:
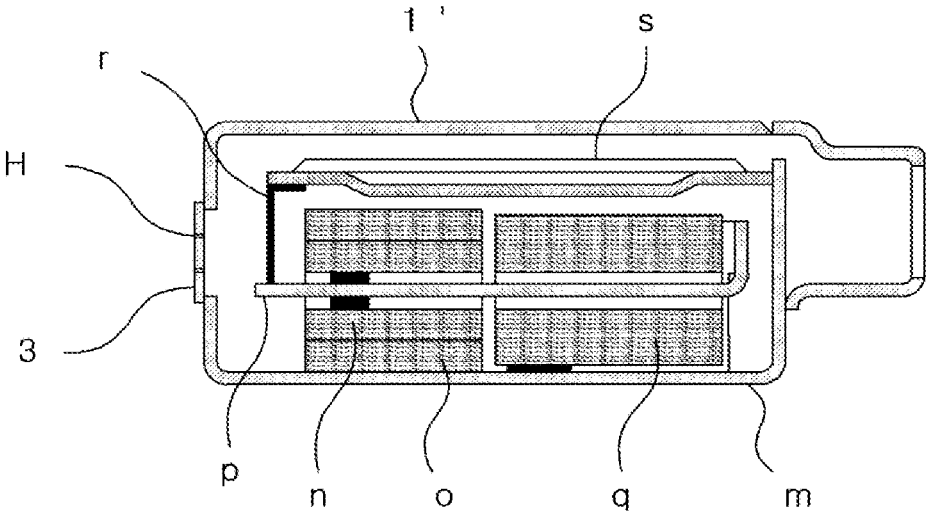

FIGS. 9 and 10 are cross-sectional views showing a blocking plate combined with a back hole of a driver unit as still another embodiment of the present invention.

Referring to FIGS. 9 and 10, a blocking plate 3 having micro holes H formed thereon may be separately manufactured and combined with the back hole BH of the driver unit 1.

Preferably, the blocking plate 3 covers only the periphery of the back hole BH of the driver unit 1.

Therefore, since the noise blocking plate 3 blocks the back hole BH formed on the rear side of the dynamic driver unit 1 or the balanced armature driver unit 1', sound generated according to the operation of the diaphragm and inversely outputted to the back holes H, as well as the external noises, can be blocked.

Meanwhile, the configuration and operation of the dynamic driver unit 1 and the balanced armature driver unit 1' will be briefly described herein.

The dynamic driver unit 1 includes a frame (yoke) (a) of a hollow cone shape; a diaphragm (b) of a hollow cone shape, vibrating inside the frame (a); an edge surround (c) elastically supporting the front end of the diaphragm (b) to the front end of the frame (a); a bobbin (d) of which the front end side is adhered to the central portion of the diaphragm (b) from the rear side of the diaphragm (b); a damper (e) of which the outer circumference is adhesively supported by the frame (a) and the inner circumference is adhered to the bobbin (d); a voice coil (f) wound around the bobbin (d); a spider (g) for supporting the voice coil (f); a permanent magnet (h) of a ring shape, arranged on the outside of the voice coil (f); a front plate (i) of a ring shape, adhesively arranged between the frame (a) and the permanent magnet (h); a rear plate (j) of a ring shape for covering the bottom of the permanent magnet (h); a pole piece (k) of a ring shape, protruding toward the inside of the bobbin (d) from the rear plate (j) with a vibration space in which the bobbin (d) vibrates up and down between the permanent magnet (h) and the front plate (i); and a dust cap (l) arranged in the middle of the diaphragm (b).

In the dynamic driver unit 1 configured like this, the permanent magnet (h), the front plate (i), the rear plate (j) and the pole piece (k) configure a magnetic circuit, and if current is applied to the voice coil (f) and the voice coil (f) has magnetism, the voice coil (f) is pulled or pushed according to the magnetic polarity of the voice coil (f). That is, if the voice coil (f) and the permanent magnet (h) have the same magnetic polarity, the voice coil (f) is pushed, and if the voice coil (f) and the permanent magnet (h) have magnetic polarities different from each other, the voice coil (f) is pulled, and thus the voice coil (f) vibrates. If the voice coil (f) vibrates, the diaphragm (b) fixed to the voice coil (f) vibrates and generates a sound.

On the other hand, the balanced armature driver unit 1' includes a frame (m); a pair of permanent magnets (n) installed in the frame (m) to be spaced apart from each other; a yoke plate (o) for covering the permanent magnets (n); an armature (p) of which one side has an air gap and is placed between the permanent magnets (n), and the other side is fixed to the frame (m); a coil (q) wound around part of the armature (p), for forming an AC magnetic field between the armature (p) and the permanent magnets (n); a connecting rod (r) connected to the armature (p); and a diaphragm (s) connected to the connecting rod (r) to vibrate and supported by the frame (m).

Although the frame (m) may have a rectangular outer shape, the outer shape of the frame (m) may not be limited thereto. The frame (m) may be formed of a hard material such as aluminum, hard resin or the like.

The pair of permanent magnets (n) are spaced apart from each other to form a DC magnetic field and may be configured of an upper magnet and a lower magnet.

The yoke plate (o) may be provided to configure a closed circuit including an upper magnet and a lower magnet. That is, a predetermined static magnetic field is generated by the upper magnet and the lower magnet, and a return path with respect to the static magnetic field is restricted by the yoke plate (o). Therefore, the yoke plate (o) may be formed of a material of high permeability having a high magnetic property.

One end of the armature (p) is placed between the pair of permanent magnets (n) spaced apart from each other. The other end in the opposite direction of the one end is formed in a bent structure of a shape bent upward and may be fixed to the frame (m). The bent structure of the other end may be changed in a variety of shapes, and any shape can be applied if the structure can be fixed to the frame (m). Since the overall height is reduced through the bent structure of the other end, the volume can be reduced. The armature (p) may be formed by stamping out a metal strip. The metal strip is easy to bend at one end. The armature (p) may be configured to include a conventional magnetic material such as Permalloy (or a Fe—Ni magnetic alloy), a Fe—Si material such as silicon steel, or other materials. The armature (p) may be formed of a material of high permeability having a high magnetic property. The armature (p) placed between the permanent magnets (n) may include an air gap between the permanent magnets (n) and the armature (p).

The coil (q) is wound around part of the armature (p), and if a signal current is applied, magnetic flux is generated around the armature (p), and an AC magnetic field is formed between the armature (p) and the permanent magnets (n).

The connecting rod (R) may be formed of a non-magnetic material having a property of high stiffness.

In the balanced armature driver unit 1' configured like this, when the AC magnetic field formed between the armature (p) and the permanent magnets (n) by the magnetic flux generated around the armature (p) when a signal current is applied to the coil (q) is overlapped with the DC magnetic field formed between the permanent magnets (n), bending deformation occurs in the armature (p) in the vertical direction. Accordingly, displacement occurs in the connecting rod (r) connected to the armature (p) in the vertical direction. In addition, as the displacement of the connecting rod (r) is transferred to the diaphragm (s) connectedly fixed on the top of the connecting rod (r), the diaphragm vibrates and generates a sound. The sound generated like this is emitted to the outside through a nozzle and finally transferred to the ears of the user.

Figure 11:
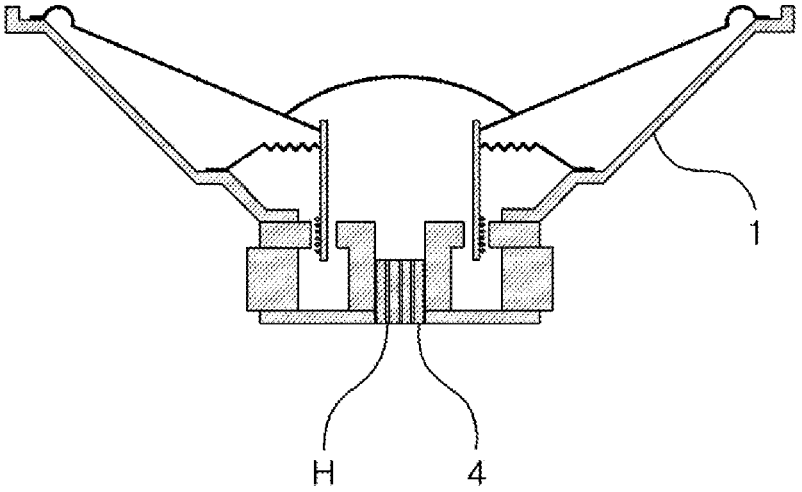
FIG. 11 is a cross-sectional view showing a blocking body inserted in a back hole of a driver unit as still another embodiment of the present invention.

FIG. 11 is a cross-sectional view showing a blocking body inserted in a back hole of a driver unit as still another embodiment of the present invention.

Referring to FIG. 11, a blocking body 4 having micro holes H formed thereon may be separately manufactured and inserted inside the back hole BH of the driver unit 1.

Figure 12:
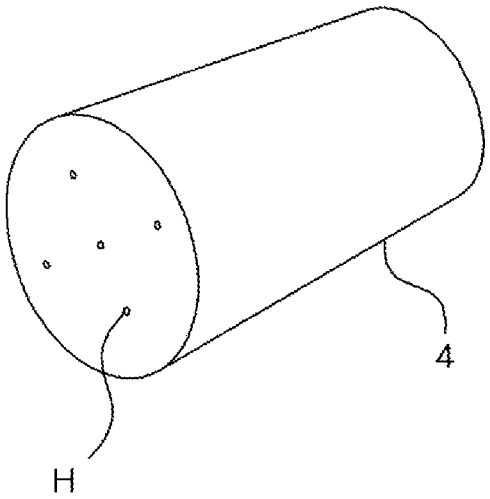
FIG. 12 is a perspective view showing the blocking body of FIG. 11.

FIG. 12 is a perspective view showing the blocking body of FIG. 11.

Referring to FIG. 12, it is preferable that the ratio of the diameter D of the micro hole H formed on the blocking body 4 to the height of the pillar of the blocking body 4 is set within a range of 1:100 to 1,000.

In this embodiment, the diameter D of the micro hole H may be formed comparatively large.

Figure 13:
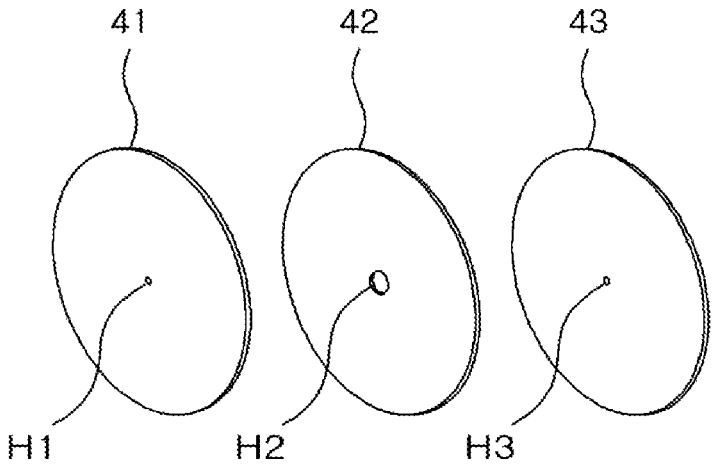
FIGS. 13 and 14 are a perspective view and a cross-sectional view showing a blocking member according to still another embodiment of the present invention.
Figure 14:
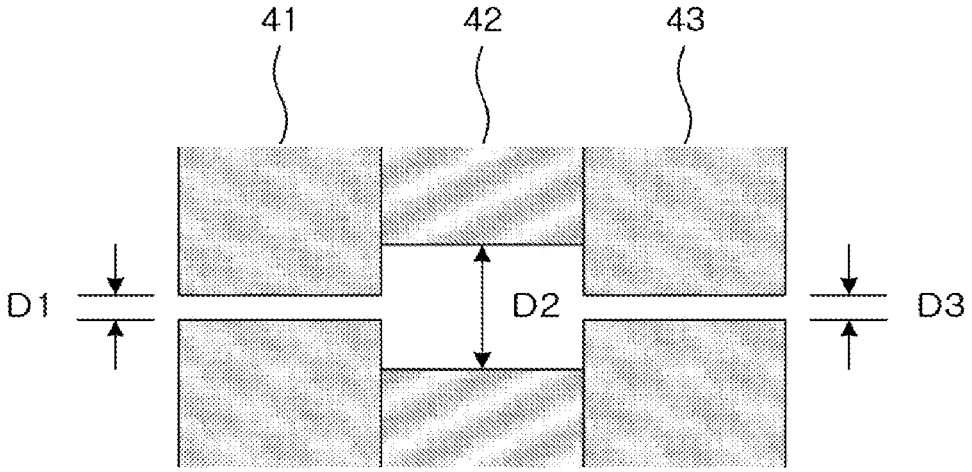

FIGS. 13 and 14 are a perspective view and a cross-sectional view showing a blocking member according to still another embodiment of the present invention.

Referring to FIGS. 13 and 14, the blocking member according to this embodiment combines blocking plates 41, 42 and 43 having holes H1, H2 and H3 of diameters D1, D2 and D3 different from each other. Here, the holes H1 and H3 of the outer blocking plates 41 and 43 may be formed to have the same the diameter D1 and D3, and preferably, the diameter D2 of the inner blocking plate 42 is larger than the diameters D1 and D3 of the outer blocking plates 41 and 43. Through this, a low pass filter (LPF) can be configured.

Meanwhile, although a case of configuring three blocking plates is described in this embodiment, the number of the blocking plates may be arbitrarily determined, and diameters D of various sizes may be applied.

In addition, the blocking member according to this embodiment may be applied to all of the blocking plates and the blocking bodies shown in FIGS. 8 to 12.

The present invention can be applied to a bluetooth earset in which a speaker and a microphone are integrated. More specifically, an in-ear microphone is provided inside the case of the earset in the external auditory meatus direction to collect the voice of a user transmitted through the external auditory meatus.

Preferably, the path from the external auditory meatus to the in-ear microphone which is formed within the case of the earset is isolated from the path from the speaker to outside of the case.

Meanwhile, as described in some embodiments, a blocking member that blocks external noises is coupled to the micro hole of the case, or a blocking member which blocks external noises is coupled to the back hole of the driver unit.

The blocking member effectively blocks high and intermediate frequency bands of noises from the outside.

The in-ear microphone collects the voice of a user transmitted from the external auditory meatus, then the earset transmits the collected voice of a user via Bluetooth protocol. low frequency bands of noises from the outside which is not blocked by the blocking member do not affect quality of sound that is transmitted by the earset via Bluetooth protocol since low frequency sound does not pass through in the signal processing procedure by the Bluetooth specification.

When the high and intermediate frequency bands of noises from the outside is blocked by the case or the driver unit the air passes through, the in-ear microphone can transmit the voice of a user more clearly.

Figure 15:
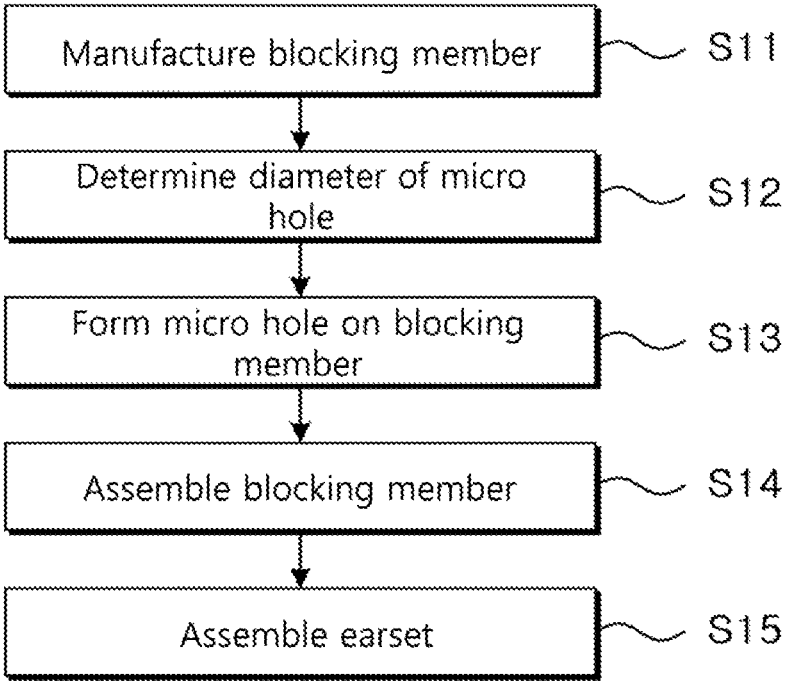
FIG. 15 is a flowchart illustrating a method of manufacturing a noise blocking earset according to an embodiment of the present invention.

FIG. 15 is a flowchart illustrating a method of manufacturing a noise blocking earset according to an embodiment of the present invention.

Referring to FIG. 15, the blocking member including the blocking plate 3 and the blocking body 4 combined with the earset case 2 or the driver unit 1 is manufactured (step S11). That is, the blocking member is manufactured after determining a material, a shape and a size of the blocking member considering a target to which the blocking member is applied. Here, the blocking member includes all of the blocking plates and the blocking bodies shown in FIGS. 8 to 14. At this point, it is preferable to apply a casting process using a mold in manufacturing the blocking member.

Subsequently, a diameter D of the micro hole H is determined within a range of 1:100 to 1,000 with respect to the thickness T of the blocking member (step S12), and at least one micro hole H is formed on the blocking member (step S13). At this point, the micro hole H may be perforated using a laser or the like, and when the size of the micro hole H is 10 μm or less, a semiconductor etching process may be applied.

Then, the blocking member is combined with the earset case 2 or the driver unit 1 (step S14), and the earset is completed by performing a process of assembling the components (step S15).

The technical spirit of the present invention has been described above through several embodiments.

It is apparent that those skilled in the art can diversely modify or change the embodiments described above from the description of the present invention. In addition, although it is not explicitly shown or described, it is apparent that those skilled in the art may make various forms of modifications including the spirit of the present invention from the description of the present invention, and this still falls within the scope of the present invention. The embodiments described above with reference to the accompanying drawings are described for illustrative purposes, and the scope of the present invention is not limited to the embodiments.

The invention claimed is:

1. A noise blocking earset comprising:

a driver unit having a back hole formed thereon;

a case having the driver unit installed therein and having a micro hole formed thereon to communicate with the back hole;

a blocking member coupled to the micro hole of the case to block external noise and allow air to pass through the micro hole; and an in-ear microphone installed in a space where external noise is blocked by the blocking member, disposed in the case and configured to collect sound transmitted from an external auditory meatus.

2. The noise blocking earset of claim 1, wherein the blocking member comprises a plurality of blocking plates, and the plurality of blocking plates comprise at least one pair of blocking plates on which micro holes having different diameters are formed.

3. A noise blocking earset comprising:

a driver unit having a back hole formed thereon;

a case having the driver unit installed therein and having a micro hole formed thereon to communicate with the back hole;

a blocking member blocking the back hole of the driver unit to block external noise and allow air to pass through back hole; and an in-ear microphone installed in a space where external noise is blocked by the blocking member, disposed in the case and configured to collect sound transmitted from an external auditory meatus.

4. The noise blocking earset of claim 3, wherein the blocking member comprises a plurality of blocking plates, and the plurality of blocking plates comprise at least one pair of blocking plates on which micro holes having different diameters are formed.

5. A noise blocking earset comprising:

a driver unit having a back hole formed thereon;

a case having the driver unit installed therein and having a micro hole formed thereon to communicate with the back hole;

a blocking member coupled to the micro hole of the case to block external noise; and an in-ear microphone installed in the case to collect sound transmitted from an external auditory meatus while external noise is blocked by the blocking member, wherein the blocking member comprises a plurality of blocking plates, and the plurality of blocking plates comprise at least one pair of blocking plates on which micro holes having different diameters are formed.

* * * * *